United States Patent [19]

Okada

[11] 4,165,628

[45] Aug. 28, 1979

[54] FIN PASS ROLL

[75] Inventor: Kuniaki Okada, Matsue, Japan

[73] Assignee: Hitachi Metals, Ltd., Japan

[21] Appl. No.: 884,166

[22] Filed: Mar. 7, 1978

[51] Int. Cl.[2] ..... B21D 5/12

[52] U.S. Cl. ..... 72/182; 219/8.5; 29/125

[58] Field of Search ..... 72/182, 181, 179; 219/8.5; 29/125, 130, 121.6

[56] References Cited

U.S. PATENT DOCUMENTS 2,948,324 8/1960 Penrose ..... 72/181 X

FOREIGN PATENT DOCUMENTS 653091 11/1962 Canada ..... 72/182

*Primary Examiner*—Milton S. Mehr

*Attorney, Agent, or Firm*—Craig & Antonelli

[57] ABSTRACT

A fin pass roll for use as a single roll or as pairs of mating forming rolls for bending a flat metal strip into a desired tubular shape or a tube form. The fin pass roll is split into three sections; that is, a fin roll having a fin and fin side rolls in such a way that the fin roll may have arcuate caliber profile which are extended to both sides from the fin and merge with the arcuate caliber profile of the adjacent fin side rolls. The fin side rolls are rotatable in unison with a drive shaft, but the fin roll is so constructed and arranged as to be rotatable independently of the drive shaft and hence the fin side rolls.

11 Claims, 9 Drawing Figures

FIN PASS ROLL

BACKGROUND OF THE INVENTION

When pipe is made by cold roll forming a suitable flat strip of metal to a tubular shape and welding the seam, the tube form passes through pairs of fin-pass rolls each having a fin roll adapted to be inserted between the adjacent lengthwise edges of the tube form so that the adjacent edges may be gradually forced to move toward each other and may be joined together by suitable welding. The present invention relates to an improvement of such fin-pass rolls.

In general, a fin-pass roll comprises right and left fin side rolls for bending a flat metal strip into a tubular shape and a fin roll which is sandwiched between the fin side rolls and is adapted to be inserted between the adjacent edges of the tube form so as to bear against them. FIGS. 1 and 2 show typical prior art fin-pass rolls, and FIG. 3 there is shown an improved fin-pass roll. In FIG. 1, a fin roll 1 and fin side rolls 2 and 3 are assembled with bolts and nuts as a unitary construction and are keyed to a drive shaft 5 so that the fin roll 1 and the side rolls 2 and 3 may be rotated in unison with the drive shaft 5, whereby a tube form 6 is formed and passed. This fin pass roll is split into three sections 1, 2 and 3 in order to overcome the problems encountered when the fin-pass roll is made as a one-piece. That is, when the fin roll 1 or the fin side roll 2 or 3 is worn out, it may be removed for repair or replacement. However the fin-pass roll of the type shown in FIG. 1 cannot eliminate the problem of rapid wear of the portions 7 of the fin roll 1 and the portions 8 of the fin side rolls 2 and 3 against which the adjacent edges of the tube form 6 are forcibly pressed. That is, due to the irregular propagation of wear at these portions 7 and 8 and to the irregularity in shape of the edges of the tube form 6 the fin-pass roll is subjected to impact forces so that frequent rupture or fracture of these portions 7 and 8 results. Furthermore the adjacent edges of the tube form 6 are forced against the fin-pass roll when the tube form 6 passes so that the deformation of the edges occurs and consequently the edges cannot be made into intimate and smooth contact with each other. As a result the edges cannot be perfectly joined to each other by welding. Moreover since the tube form 6 is forced to slide relative to the fin-pass roll, surface quality is considerably degraded.

The fin pass roll of the type shown in FIG. 2 had been proposed in order to overcome the above problems encountered in the fin pass roll shown in FIG. 1. In order to eliminate the slip between the tube form 6 and the fin roll due to the difference between the feed of the tube form 6 and the peripheral velocity of the fin roll 9, the fin roll 9 is so constructed and arranged as to be able to rotate independently of the fin side rolls 10 and 11. As a result wear of the portions 12 of the fin roll 9 against which are forced the edges of the tube form 6 may be considerably suppressed, but the problem of wear and cracking of the portions 13 of the fin side rolls 10 and 11 against which are forced the edges of the tube form 6 cannot be eliminated so that there still remains the problem of rupture or fracture of these portions 13.

In order to overcome the problems encountered in the fin pass rolls of the types shown in FIGS. 1 and 2, there had been proposed a fin pass roll of the type shown in FIG. 3. The fin-pass roll is split into the fin roll 15 and the fin side rolls 16 and 17 in such a way that the fin roll 15 may have arcuate caliber profile which merge with the arcuate caliber profile of the fin side rolls 16 and 17. As a result the fin side rolls 16 and 17 are spaced apart from the edges of the tube form 6 so that the problem of wear of the fin side rolls 16 and 17 may be overcome. That is, wear occurs only on the fin roll 15 at portions 18 and 19 and the replacement or repair of only the fin roll 15 whose tool cost is relatively inexpensive may suffice. In other words, the replacement of the expensive fin side rolls of the fin pass roll shown in FIG. 1 or 2 may be advantageously eliminated. However, the fin roll 15 is still assembled with the fin side rolls 16 and 17 with bolts and nuts as a unitary construction so that the edges of the tube form 6 are still forced against the fin roll 15 and the slip occurs the tube form 6 and the fin pass roll. As a consequence the problem of wear and cracking of the portions 18 and 19 of the fin roll 15 cannot be overcomed. Thus the prior art fin pass rolls have been all unsuccessful in eliminating the fundamental problem of wear and cracking.

SUMMARY OF THE INVENTION

In order to overcome these and other problems, the inventor made extensive studies and experiments and found out the countermeasure for avoiding the excessive and rapid wear and resulting rupture or fracture of the fin roll and the fin side rolls against which the edges of the tube form are forcibly pressed and the arcuate caliber profile adjacent to the fin roll of the fin side rolls.

One of the objects of the present invention is therefore to provide a fin pass roll with which a pipe with high quality and a higher degree of roundness may be produced.

Another object of the present invention is to provide a fin pass roll of such a construction that the parts which are mostly subjected to wear may be made of a heat-resisting and wear-resisting material.

A further object of the present invention is to provide a fin pass which can effectively resist against wear and rupture or fracture, whereby a long life time may be ensured.

Briefly stated, to the above and other ends the present invention provides a fin pass roll which is split into three sections; that is, a fin roll and fin side rolls in such a way that the fin roll may have arcuate caliber profile which are extended to both sides from a fin of the fin roll and merge with the arcuate caliber profile of the adjacent fin side rolls. Furthermore the fin roll is so constructed and arranged that it may rotate independently of the fin side rolls and a drive shaft upon which are mounted the fin side rolls. According to one aspect of the present invention, the fin roll is further split into three sections; that is, a fin and intermediate rolls which sandwich the fin. According to another aspect of the present invention, in the longitudinal cross section of the fin pass roll, opposed surfaces between the fin roll and the fin side rolls are perpendicular to tangent lines at points of intersection of split line and arcuate caliber profiles of the fin roll and the fin side rolls in outer caliber sides of rolls and are perpendicular to the axis of the drive shaft in inner periphery sides of the rolls.

The above and other objects, effects and advantages of the present invention will become more apparent from the following description of preferred embodiments thereof taken in conjunction with the accompanying drawings.

DESCRIPTION OF THE PREFERRED EMBODIMENTS

Figure 1:
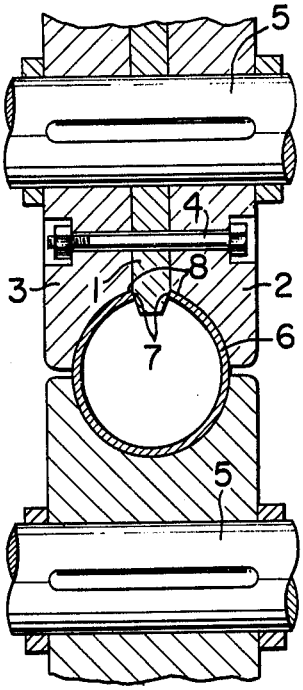
FIG.1 PRIOR ART
FIGS. 1, 2 and 3 are cross sectional views of typical prior art fin pass rolls.
Figure 3:
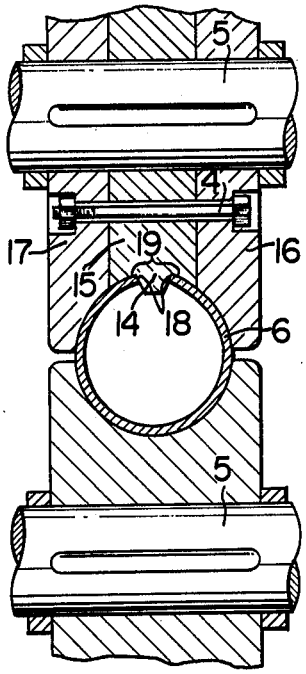
FIG.3 PRIOR ART
Figure 2:
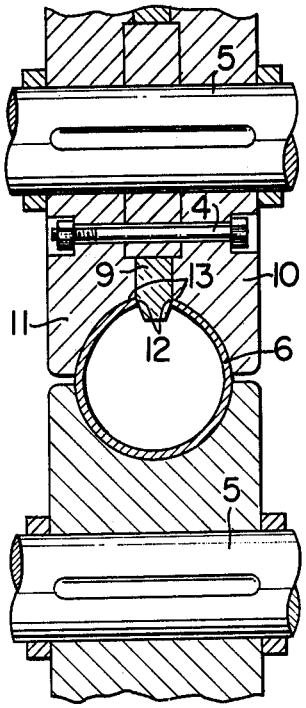
FIG.2 PRIOR ART

Prior Art, FIGS. 1–3

With the prior art constructions of the fin pass rolls shown in FIGS. 1–3, due to springback of the tube form 6, the edges thereof are forcibly pressed against the arcuate caliber profile of the fin side rolls adjacent to the fin roll or against the arcuate caliber profile of the fin roll. The tube form 6 is advanced due to the frictional forces produced between the tube form 6 and the fin pass roll as the latter is rotated. The peripheral velocity is dependent upon the size of the diameter of the forming rolls which are, in general, rotated at the same speed while the tube form 6 is advanced at the same feed throughout pairs of cold-forming rolls. As a result slip occurs between the tube form and the forming rolls. When the fin roll and the fin side rolls are joined together and keyed to the drive shaft or to a suitable mount which, in turn, is mounted on the drive shaft, wear and cracking occur because of the multiplicative effect between heavy pressures exerted by the edges of the tube form against the caliber surfaces of the fin side rolls adjacent to the fin roll (See FIGS. 1 and 2) or against the caliber surfaces adjacent to the fin of the fin roll (See FIG. 3) and the slip between the tube form and the fin pass roll as described in detail above. As a result rupture or fracture of the fin pass rolls occurs.

The Invention, FIGS. 4–9

In view of the above, according to the present invention even when the edges of the tube form are forcibly pressed against the fin pass roll, the slip between the tube form and the fin pass roll may be reduced to a minimum by reducing the difference between the velocity of the tube form passing the fin pass rolls and the peripheral velocity of the fin pass forming rolls to a minimum, whereby the problem of wear and rupture or fracture of the fin pass rolls may be overcome. Furthermore, according to the present invention the fin pass roll is so split that the fin roll may have arcuate caliber profile which merges with the corresponding surfaces of the fin side rolls, and the fin roll is so mounted on the drive shaft that it may be rotated independently of the fin side rolls and at different velocity.

Figure 4:
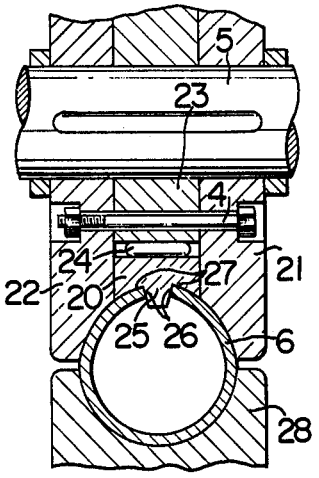
FIGS. 4–9 are cross sectional views of the preferred embodiments of the present invention.

First Embodiment, FIG. 4

Referring to FIG. 4, the fin pass roll comprises a fin roll 20, fin side rolls 21 and 22 and a sleeve 23. The fin side rolls 21 and 22 and the sleeve 23 are assembled as a unitary construction with bolts and nuts 4 and are keyed to the drive shaft 5 for rotation in unison therewith. The fin roll 20 which is sandwiched between the fin side rolls 21 and 22 is fitted into the sleeve 23 with a needle bearing 24 interposed therebetween so that the fin roll 20 may rotate independently of the fin side rolls 21 and 22 and the sleeve 23 and at different velocity.

The fin pass roll is splitted in such a way that the fin roll 20 may have arcuate caliber surfaces which merge with the arcuate caliber surfaces of the fin side rolls 21 and 22. Preferably the extension of the split line between the fin roll 20 and the fin side roll 21 or 22 intersects at a point spaced apart from the center of the caliber by a distance substantially equal to one quarter of the diameter of the caliber, but it is to be understood that the present invention is not limited to such arrangement as described above. The edges of the tube form are most forcibly pressed against the portions 26 of the fin 25 and the portions 27 adjacent to the fin 25 of the fin roll 20, and the fin side rolls 21 and 22 are spaced apart from these portions 26 and 27.

The fin side rolls 21 and 22 and a lower forming roll 28 which are mounted on the drive shaft 5 and another drive shaft serve not only for bending a flat metal strip into a tubular shape or a tube form 6 but also for advancing the tube form 6. Because of the difference in diameter between the fin side rolls 21 and 22 and the lower forming roll 28 they rotate at different peripheral velocities even when they are rotated at the same rotational speed so that slip occurs between them and the tube form 6 which is advanced at the same velocity through pairs of cold-forming rolls. However, the edges of the tube form 6 which are pressed against the fin pass roll under the greatest pressures are spaced apart from the fin side rolls 21 and 22 which are keyed to the drive shaft 5 so that rapid wear and rupture or fracture of the fin pass roll and surface flaws of the tube form 6 may be substantially eliminated.

The difference in peripheral velocity over the arcuate caliber profile of the fin roll 20 is less and the fin roll 20 may rotate at the velocity same as the tube form 6 so that no slip occurs between the tube form 6 and the fin roll 20. Consequently the fin roll 20 may bear only against the forming force exerted to the flat metal strip or the tube form.

Since no slip occurs between the tube form and the fin roll, even when the edges of the tube form 6 are forcibly pressed against the fin roll 20, wear of the portions 26 and 27 of the fin roll 20 may be considerably minimized; rupture or fracture of the fin pass roll may be avoided; and surface flaws of the tube form 6 may be eliminated.

Figure 5:
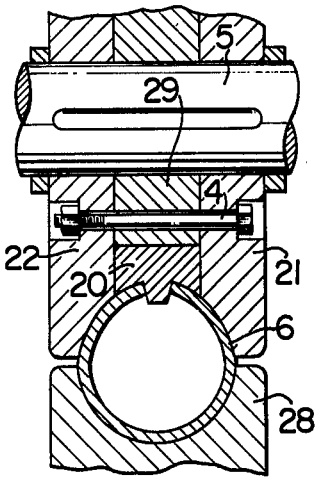

Second Embodiment, FIG. 5

The second embodiment shown in FIG. 5 is substantially similar in construction to the first embodiment shown in FIG. 4 except that the fin roll 20 is directly, slidably fitted into the sleeve 29. That is, the sleeve 29 of the second embodiment serves as a journal bearing. The second embodiment may attain the same effects and advantages as the first embodiment.

Figure 6:
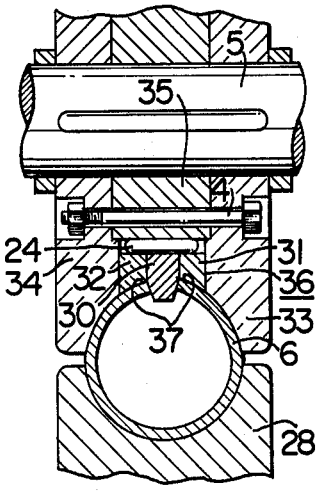

Third Embodiment, FIG. 6

The fin roll of the third embodiment shown in FIG. 6 is further split into three sections or a fin 30 and intermediate rolls 31 and 32 all of which are rotatable independently of the drive shaft 5 and the fin side rolls 33 and 34 and the sleeve 35. The fin side rolls 33 and 34 and the sleeve 35 are joined together with bolts and nuts 4 and are keyed to the drive shaft 5 for rotation in unison therewith. The fin 30 and the intermediate rolls 31 and 32 are rotatably fitted into the sleeve 35 with a needle bearing 34 interposed therebetween so that the fin roll consisting of the fin 30 and the intermediate rolls 31 and 32 may be rotated independently of the fin side rolls 33 and 34 and the sleeve 35 and at different velocity.

The third embodiment may attain the same effects and advantages as the first and second embodiments shown in FIGS. 4 and 5. Furthermore wear of the fin 30 and the intermediate rolls 31 and 32 may be considerably minimized, and consequently the problem of wear and rupture or fracture of the fin roll 36 may be eliminated and the surface flaws on the tube form 6 may be avoided.

With the prior art fin pass rolls, the portions 37 are frequently susceptible to wear and rupture or fracture due to the slip between the tube form 6 and the fin roll 36. However, according to the third embodiment, the fin roll 36 comprises the fin 30 and the intermediate rolls 31 and 32 which may be rotatable independently of the fin side rolls 33 and 34 and the sleeve 35 whereby their wear may be considerably reduced. Furthermore the intermediate rolls 31 and 32 may be made of a wear- and heat-resisting material in order to resist against wear and heat caused by the slip between the tube form 6 and the fin pass roll, whereby a long lifetime of the fin pass roll may be ensured.

Since the fin pass roll is split into the fin side rolls 33 and 34 the fin 30 and the intermediate rolls 31 and 32, the replacement of the worn parts may be greatly facilitated and the tool costs may be considerably reduced.

Figure 7:
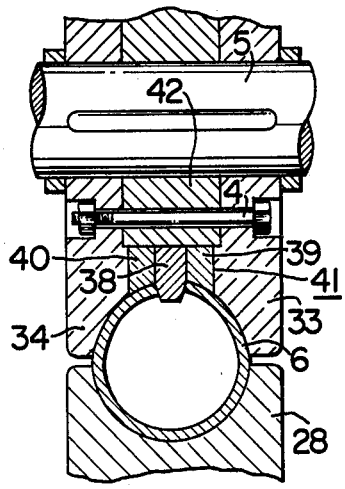

Fourth Embodiment, FIG. 7

The fourth embodiment shown in FIG. 7 is substantially similar in construction to the third embodiment shown in FIG. 6 except that the fin 38 and the intermediate rolls 39 and 40 are directly and slidably fitted into the sleeve 42. That is, as with the second embodiment, the sleeve 42 serves as a journal bearing. The effects and advantages of the fourth embodiment are substantially same with those of the third embodiment.

Figure 8:
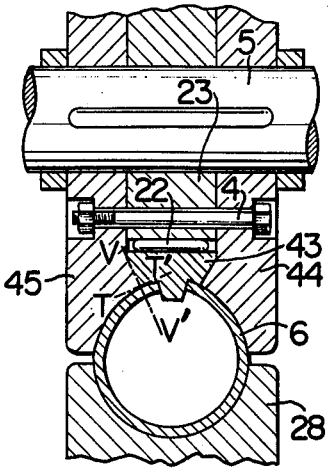

Fifth Embodiment, FIG. 8

In the first and fourth embodiments, the angle between the split line between the fin roll or the intermediate roll and the side roll at the point where the split line intersects the caliber profile is acute, but in the fifth embodiment this angle is 90° in order to make the fin roll more resistant to rupture or fracture. As shown in FIG. 8, the outer portion of the fin roll 43 is tapered inwardly. More particularly, the outer portion is split from the fin side roll 45 along the vertical line V-V′ which is perpendicular to the tangent line T-T′ at the point of intersection of the arcuate caliber profile of the fin roll 43 and fin side roll 45 so that the angle between the vertical line V-V′ and the tangent line T-T′ at the point of intersection between the vertical line V-V′ and the arcuate caliber profile of the fin roll 43 and the fin side roll 45 is 90° or a right angle.

Figure 9:
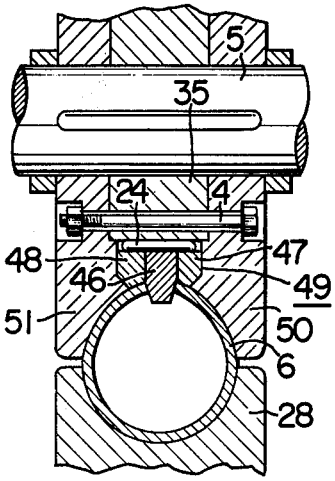

Sixth Embodiment, FIG. 9

The sixth embodiment shown in FIG. 9 is substantially similar in construction to the third embodiment shown in FIG. 6 except that the outer portions of the intermediate rolls 47 and 48 are tapered or split from the fin side rolls 50 and 51 in the manner described above in the fifth embodiment.

In both the fifth and sixth embodiments, the outer portion of the fin roll 43 or the outer portions of the intermediate rolls 48 and 49 are tapered inwardly so that the fin roll 43 or the intermediate rolls 48 and 49 may not oppose to the fin side rolls 44 and 45 or 50 and 51 at an acute angle. As a result, the resistance to wear and fracture of the fin roll 43 or the fin roll 46 and intermediate roll 48 and 49 may be considerably improved and consequently a long life time of the fin pass roll may be ensured.

So far the present invention has been described in conjunction with the preferred embodiments, but it is understood that the present invention is not limited thereto. Briefly stated, the novel feature of the present invention resides in the fact that the fin pass roll is split into the fin roll and fin side rolls in such a way that the fin roll may have arcuate caliber profile which extends to both sides from the fin and merge with the arcuate caliber profile of the adjacent fin side rolls.

As discribed above, according to the present invention wear and rupture or fracture of the fin roll and fin side rolls may be avoided so that a long life time of the fin pass roll may be ensured and pipes with high quality and a smaller degree of out of roundness may be produced.

I claim:

1. A fin pass roll for use in a single or multiple roll stands for forming a flat metal strip into a desired tubular shape, characterized in that the fin pass roll is divided into a fin roll and fin side rolls in such a way that said fin roll has an arcuate profile which extends to both sides from a fin of said fin roll and merges with an arcuate profile of said fin side rolls; means are provided for joining said fin side rolls to a drive shaft for rotation in unison therewith; and in that means are provided for mounting said fin roll so as to be rotatable independently of said fin side rolls and the drive shaft.

2. A fin pass roll as set forth in claim 1, further characterized in that said fin roll is further divided into a fin and intermediate rolls disposed on respective sides of said fin.

3. A fin pass roll as set forth in claim 2, further characterized in that said means for mounting said fin roll includes a sleeve adapted to be mounted on the drive shaft whereby said fin roll is rotatable independently of the drive shaft.

4. A fin pass roll as set forth in claim 2, further characterized in that said mounting means for said fin roll includes a sleeve mounted on the drive shaft and a bearing means interposed between said fin roll and said sleeve.

5. A fin pass roll as set forth in claim 4, further characterized in that said bearing means is a needle bearing.

6. A fin pass roll as set forth in claim 2, further characterized in that said intermediate rolls are made of a heat-resisting and wear-resisting material, which material differs from materials of said fin and said fin side rolls.

7. A fin pass roll as set forth in claim 1, further characterized in that said means for mounting said fin roll includes a sleeve adapted to be mounted on the drive shaft whereby said fin roll is rotatable independently of the drive shaft.

8. A fin pass roll as set forth in claim 1, further characterized in that said mounting means for said fin roll includes a sleeve mounted on the drive shaft and a bearing means interposed between said fin roll and said sleeve.

9. A fin pass roll as set forth in claim 8, further characterized in that said bearing means is a needle bearing.

10. A fin pass roll as set forth in claim 9 further characterized in that, a longitudinal cross section of said fin pass roll, said fin roll and said fin side rolls have opposed surfaces which are substantially perpendicular to tangent lines extending through points of intersection of split lines between said fin roll and said fin side rolls and arcuate profiles of said fin roll and said fin side rolls at outer sides of rolls, and in that the opposed surfaces are perpendicular to an axis of the drive shaft.

11. A fin pass roll as set forth in claim 1, further characterized in that, in a longitudinal cross-section of said fin pass roll, said fin roll and said fin side rolls have opposed surfaces which are substantially perpendicular to tangent lines extending through points of intersection of split lines between said fin roll and said fin side rolls and arcuate profiles of said fin roll and said fin side rolls at outer sides of said rolls, and in that opposed surface are perpendicular to an axis of the drive shaft.

* * * * *